United States Patent [19]

Perry

[11] 4,063,634

[45] Dec. 20, 1977

[54] OSCILLATING FLATWARE WASHING DEVICE

[75] Inventor: Kenneth E. Perry, Wellesley, Mass.

[73] Assignee: Adamation, Inc., Newton, Mass.

[21] Appl. No.: 743,596

[22] Filed: Nov. 22, 1976

[51] Int. Cl.[2] ..... B65G 17/16

[52] U.S. Cl. ..... 198/478; 198/631; 198/701; 198/802; 134/126

[58] Field of Search ..... 198/478, 631, 646, 701, 198/710, 793, 797, 800, 802, 706; 259/72, 73; 134/61, 70, 126, 161; 34/60, 69, 164, 185; 432/134

[56] References Cited

U.S. PATENT DOCUMENTS

| | | | |
|---|---|---|---|
| 1,419,300 | 6/1922 | Ormsby | 259/73 |
| 2,027,266 | 1/1936 | Bogaty | 198/802 |
| 3,521,650 | 7/1970 | Barton et al. | 134/70 |

FOREIGN PATENT DOCUMENTS

| | | | |
|---|---|---|---|
| 657,063 | 2/1938 | Germany | 134/70 |
| 1,018,487 | 1/1966 | United Kingdom | 259/73 |

*Primary Examiner*—Johnny D. Cherry
*Assistant Examiner*—Joseph E. Valenza
*Attorney, Agent, or Firm*—Richard L. Stevens

[57] ABSTRACT

A device for holding flatware which flatware is cleaned in a commercial warewashing machine is disclosed. The device is secured to a conventional dolly. A drive wheel on the device engages the conveyor pan. As the dolly moves, the drive wheel oscillates a frame about a fixed axis. The frame carries the baskets which loosely hold the flatware. As the dolly moves the flatware is tossed to and fro eliminating nesting to ensure all surfaces are contacted by the wash water.

8 Claims, 5 Drawing Figures

OSCILLATING FLATWARE WASHING DEVICE

BACKGROUND AND BRIEF SUMMARY OF THE INVENTION

In commercial warewashers the wares to be cleaned, such as dishes, glasses, flatware, etc., are placed in suitable trays and the trays placed on dollies or on an endless conveyor. The conveyor or driving mechanism associated with dollies, carries the trays through a loading station, prewash, wash, prerinse and rinse zones and to an unloading station. Flatware, such as knives, forks, spoons, etc. are commonly placed in an apertured cylindrical container in a generally upright position. These containers pass through the appropriate prewash, wash, prerinse and rinse zones.

Machine operators are instructed to arrange the flatware to minimize any nesting or any overlapping of the individual pieces. This is not alwasy done by the machine operator. Even assuming the machine operator performs his task satisfactorily the force of the various sprays particularly in the prewash zone dislodge the flatware within the container. This results in nesting of the pieces of flatware and prevents the entire surfaces of all pieces from being properly cleaned.

The present invention is directed to a device for carrying flatware which prevents nesting of the flatware and allows the entire surface of the flatware to be cleaned.

Briefly, the invention comprises a frame adapted to travel in a conventional conveyor pan. A cradle adapted to oscillate about a fixed axis and a drive assembly are both secured to the frame. The drive assembly engages a portion of the conveyor pan. A rocker arm is pinned at one end to the cradle and pinned eccentrically at the other end to a drive member which drive member engages the drive assembly. As the frame travels along the conveyor pan the drive assembly drives the drive member which in turn effects oscillatory movement of the cradle about a fixed axis. The flatware is disposed in containers or baskets which are received and supported by the cradle. Therefore, as the flatware carried by the cradle passed through the prewash, wash and rinse zones it is continuously tossed to and fro to prevent nesting and insures that all surfaces are exposed to the various sprays.

In the preferred embodiment of the present invention, the frame is secured to a convention dolly which dolly is driven along a conveyor pan. These dollies typically include discus shaped wheels which travel in tracks on opposed sides of the conveyor pan. The drive assembly includes a drive wheel which engages one of these tracks and the frame of the device is disposed such that its weight insures constant frictional engagement of the drive wheel with the track. The drive wheel includes at its upper portion, a first bevel gear which engages a second bevel gear. Secured eccentrically to the second bevel gear is a rocker arm which is secured to the cradle. The degree of oscillation is controlled by a stopper arm to insure that none of the articles are thrown or fall out of the baskets.

DESCRIPTION OF THE PREFERRED EMBODIMENT

Figure 1:
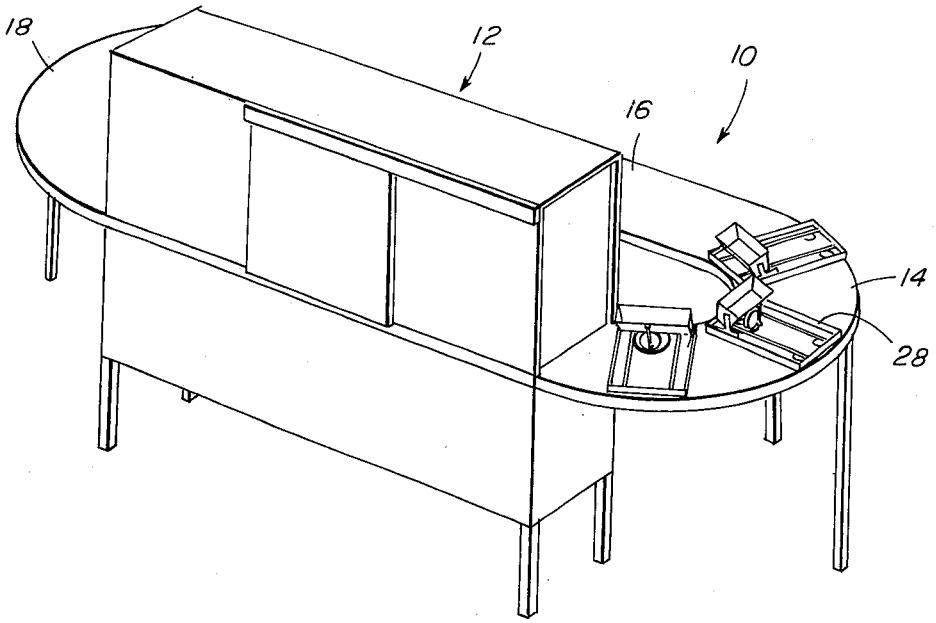
FIG. 1 is a schematic illustration of a flatware washer embodying the invention secured to a conventional dolly in a typical warewasher.

A commercial warewasher 10 such as an A-11, manufactured by Adamation, Inc. of Newton, Massachusetts, is shown in FIG. 1. It includes a housing 12 for the prewash, wash, prerinse and rinse zones; and endless conveyor pan 14 and loading and unloading stations 16 and 18 respectively. The warewasher 10 is conventional and need not be described in detail.

Figure 2:
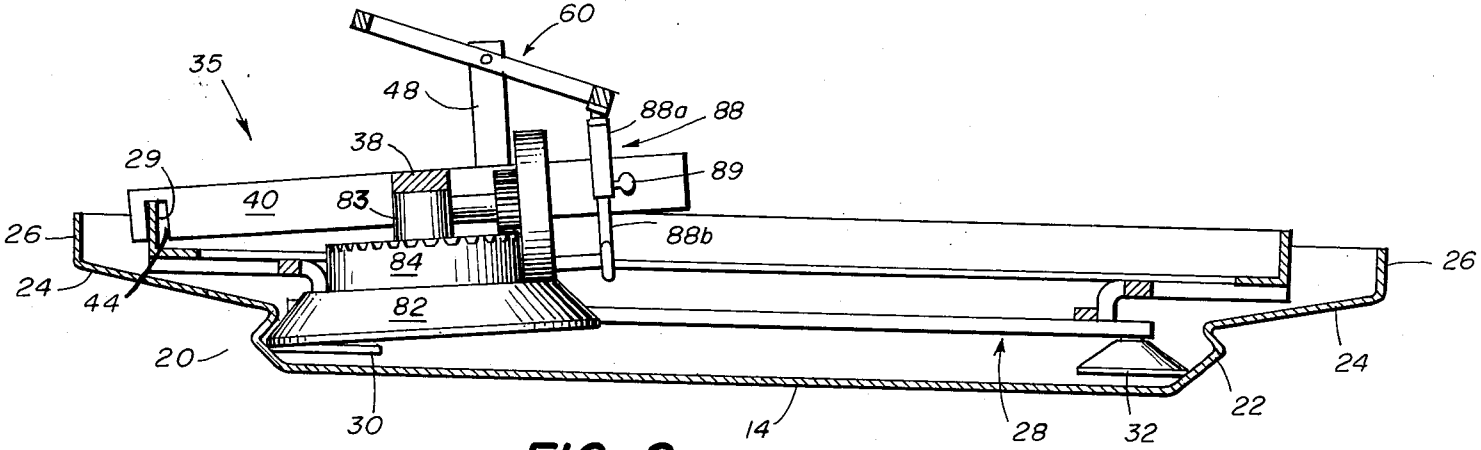
FIG. 2 is a side view of the frame secured to the dolly including the drive assembly and cradle.

Referring to FIG. 2, the conveyor pan 14 has its sides shaped to form two opposed U-shaped tracks 20 and 22 and an inwardly sloped surface 24 which terminates in a flanged edge 26. Conventional dollies 28 are driven along the tracks by a drive mechanism (not shown). The dollies 28 are adapted to carry trays which contain dishes, glassware, etc. Disposed on either side of the dollies are two sets of discus-shaped rollers 30 and 32 which travel in the tracks 20 and 22 respectively. Also included are strengthening members **34*a*, 34*b* and 34*c* (see FIG. 4**).

In the present invention, a flatware washer 35 is removably secured to a dolly such as 28. More particularly, referring to FIG. 4, the washer 35 comprises a frame 36 to which is secured a cradle 60 and a drive assembly 80.

The frame 36 includes a horizontal support member 38 fixedly secured at either end to hooking members 40 and 42. The hooking members include grooves 44 and 46 at one end, which are adapated to receive an edge 29 of the dolly 28 in releasable engagement (see FIG. 2). Spaced apart from the other ends of the hooking members 40 and 42 are vertically extending cradle supports 48 and 50. The grooves are formed in the hooking members 40 and 42 such that the frame and thus the flatware washer once secured is inclined upwardly in reference to the horizontal.

Figure 3:
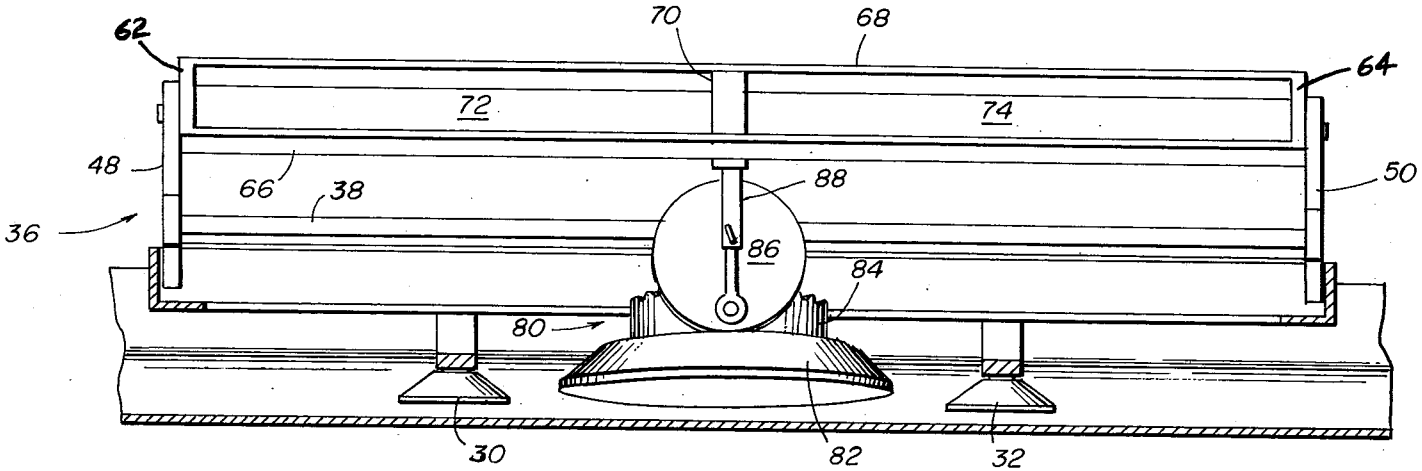
FIG. 3 is a front view of FIG. 2.

Referring to FIG. 3, the cradle 60 includes end members 62 and 64 rotatably pinned at their centers to the cradle supports 48 and 50; and side members 66 and 68 which define with the end members a rectangular support. A basket support 70 is secured to the side members 66 and 68 to define apertures 72 and 74 in which the flatware baskets are received.

The drive assembly 80 includes a drive wheel 82 rotatably secured to a fixed shaft 83 which shaft 83 is secured to the center of the horizontal support member 38. The upper surface of the wheel 82 is received in frictional engagement with the track 20. The drive assembly 80 also includes a first bevel gear 84 formed as part of the drive wheel which meshes with a second bevel gear 86 pinned to the horizontal shaft 83. An adjustable rocker 88 is eccentrically pinned to the outer periphery of the gear 86 and to the side member 66 of the cradle 60. The rocker arm 88 comprises sections **88*a* and 88*b* with section 88*b* telescopically received in section 88*a*. A screw 89** maintains the sections in fixed relationship.

Figure 4:
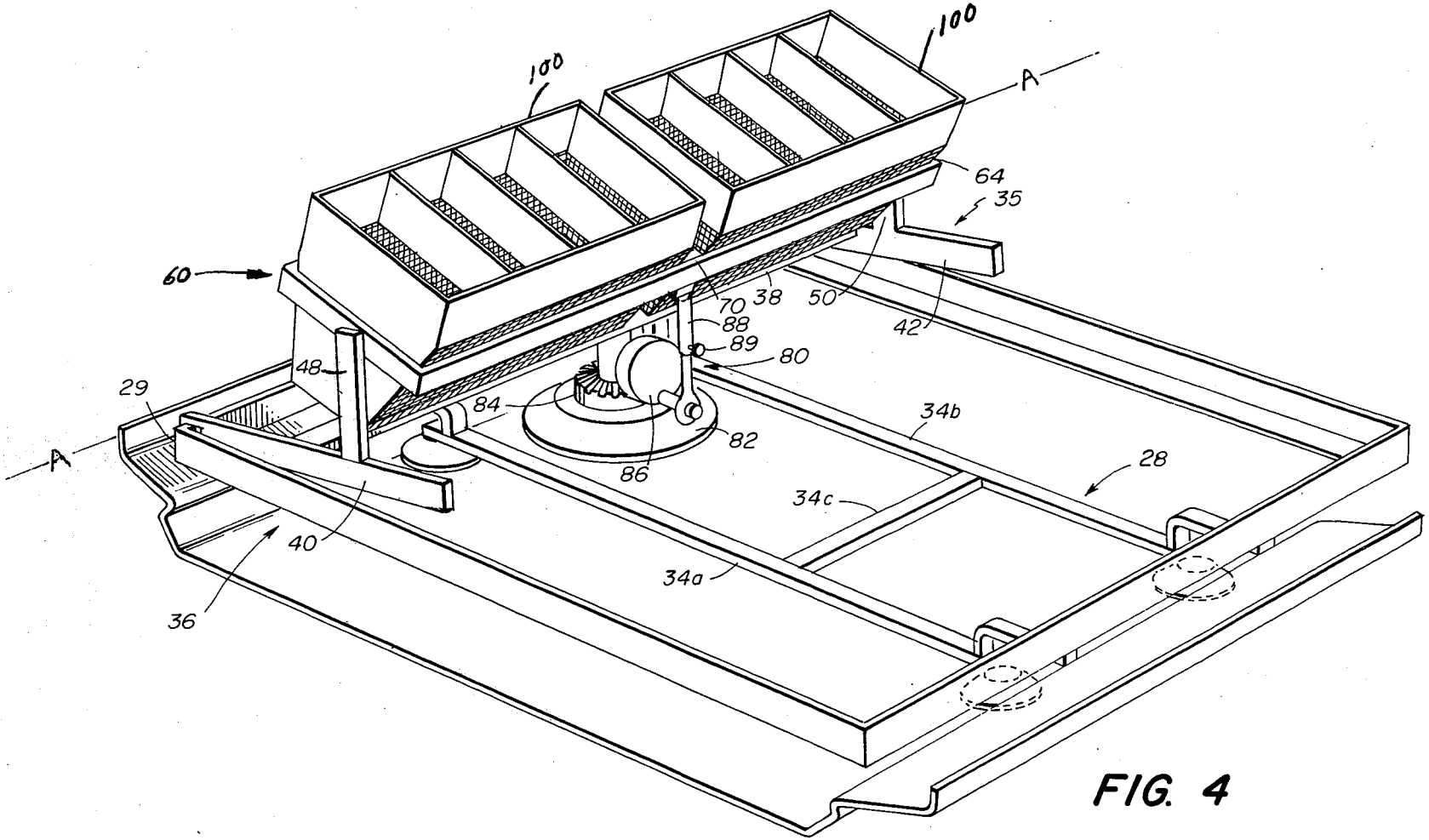
FIG. 4 is a perspective illustration of the flatware washer.

As shown in FIG. 4, baskets 100 are received in the cradle 60.

Figure 5:
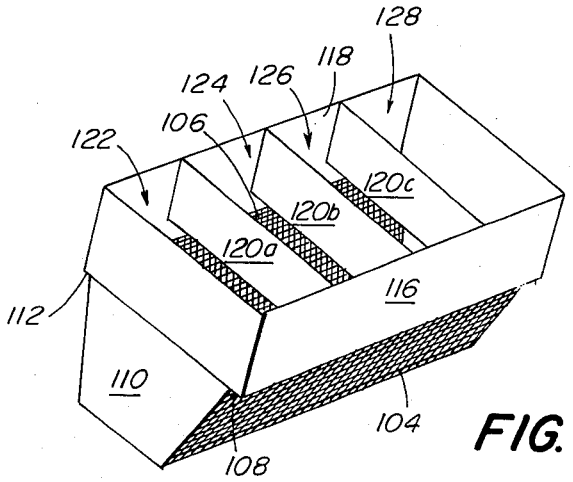
FIG. 5 is a perspective illustration of a flatware basket.

Referring to FIG. 5, the basket 100 is generally rectangular in shape and has a mesh floor (not shown) and mesh front and rear walls 104 and 106 extending upwardly and slightly outwardly and having a step 108 formed in the upper portion thereof. Side walls 110 each include steps 112. Front and back panels 116 and 118 are joined to the side walls. Partitions 120*a*, 120*b* and 120*c* in parallel and equally spaced apart relationship extend across the basket the front panel to the back panel to form compartments 122, 124, 126 and 128 in the basket. The flatware is disposed in the compartments which ensure that the flatware will be maintained in a substantially upright position.

In the operation of the present invention, the dollies 28 are driven on the conveyor pan 14. The hooking members 40 and 42 of the washer 35 are secured to the dolly 28, the weight of the washer 35 forcing the drive wheel 82 against the track 20. The movement of the dolly 28 rotates the drive wheel 82, and the first bevel gear 84 drives the second bevel gear 86. The rocker arm 88 effects oscillation of the cradle 60 about the longitudinal axis A-A shown in FIG. 4. In this manner the flatware in the baskets are continuously tossed to and fro and nesting is eliminated. The rocker arm 88 may be adjusted to vary the degree of oscillation.

Having described my invention, what I now claim is:

1. A flatware washer for use in a warewasher which warewasher includes a plurality of dollys adapted to travel in a conveyor pan, which flatware washer comprises:

a. a frame adapted to be secured to and travel on a conveyor pan;

b. a cradle rotatably secured to the frame and adapted to carry flatware;

c. a drive assembly secured to the frame which includes i. a first drive means in contacting engagement with a portion of the conveyor pan;

ii. a second drive means in driving engagement with the first drive means; and, iii. a third drive means in driving engagement with the second drive means; and d. a rocker arm rotatably secured at one end to the cradle and eccentrically pinned at the other end to the third drive means whereby when the frame travels on the conveyor pan the first drive means rotates driving the second drive means which in turn drives the third drive means causing the rocker arm to oscillate the cradle about a fixed axis.

2. The flatware washer of claim 1 wherein the second and third drive means are bevel gears.

3. The flatware washer of claim 1 wherein the rocker arm is adjustable to vary the degree of oscillation.

4. The flatware washer of claim 1 wherein the dolly includes at least one edge and the frame includes hooking members which releasably engage said edge.

5. The flatware washer of claim 4 wherein the hooking members are disposed on one side of the frame and are formed to engage the edge such that the weight of the frame places the first drive means in contacting engagement with the conveyor pan.

6. The flatware washer of claim 1 wherein the cradle includes a plurality of partitions to define compartments.

7. The flatware washer of claim 6 which includes a plurality of apertured baskets received in the compartments of the cradle.

8. The flatware washer of claim 7 wherein the baskets include a stepped outer surface which is received and supported by the cradle.

* * * * *